United States Patent [19]

Mola

[11] 4,019,565

[45] Apr. 26, 1977

[54] INGOT MOLD FOR CONTINUOUS ROTARY CASTING

[75] Inventor: Michel Mola, Paris, France

[73] Assignee: Creusot-Loire Vallourec, Paris, France

[22] Filed: Aug. 9, 1976

[21] Appl. No.: 712,966

[30] Foreign Application Priority Data

Aug. 14, 1975 France ..... 75.25325

[52] U.S. Cl. ..... 164/283 M

[51] Int. Cl.[2] ..... B22D 11/04

[58] Field of Search ... 164/283 M, 283 MT, 283 R, 164/348, 82, 273 R, 149, 297

[56] References Cited

UNITED STATES PATENTS

| | | | |
|---|---|---|---|
| 3,098,269 | 7/1963 | Baier | 164/283 M |
| 3,527,287 | 9/1970 | Huber | 164/348 X |
| 3,736,980 | 6/1973 | Peytavin et al. | 164/283 M |
| 3,746,077 | 7/1973 | Lohikoski et al. | 164/283 M X |
| 3,872,913 | 3/1975 | Lohikoski | 164/82 X |
| 3,941,183 | 3/1976 | Vedda et al. | 164/283 M X |

FOREIGN PATENTS OR APPLICATIONS

| | | | |
|---|---|---|---|
| 1,031,936 | 6/1958 | Germany | 164/283 M |
| 42-25544 | 1/1964 | Japan | 164/283 M |

*Primary Examiner*—Ronald J. Shore
*Attorney, Agent, or Firm*—Brisebois & Kruger

[57] ABSTRACT

Ingot mold for continuous rotary casting has an inner sleeve, the inner surface of which contacts the casting and rotates therewith and a stationary outer jacket, in which said sleeve is rotatably mounted. A pair of concentric annular ducts for cooling fluid are formed in the sleeve concentrically with respect to the cooling surface and are connected at their upper ends. Bearing means are provided between the sleeve and jacket, and labyrinthine seals are located above and below the bearing means. The cooling fluid enters the outermost duct and leaves the innermost duct below the bearing so that there is no possibility that water will enter the bearing.

6 Claims, 1 Drawing Figure

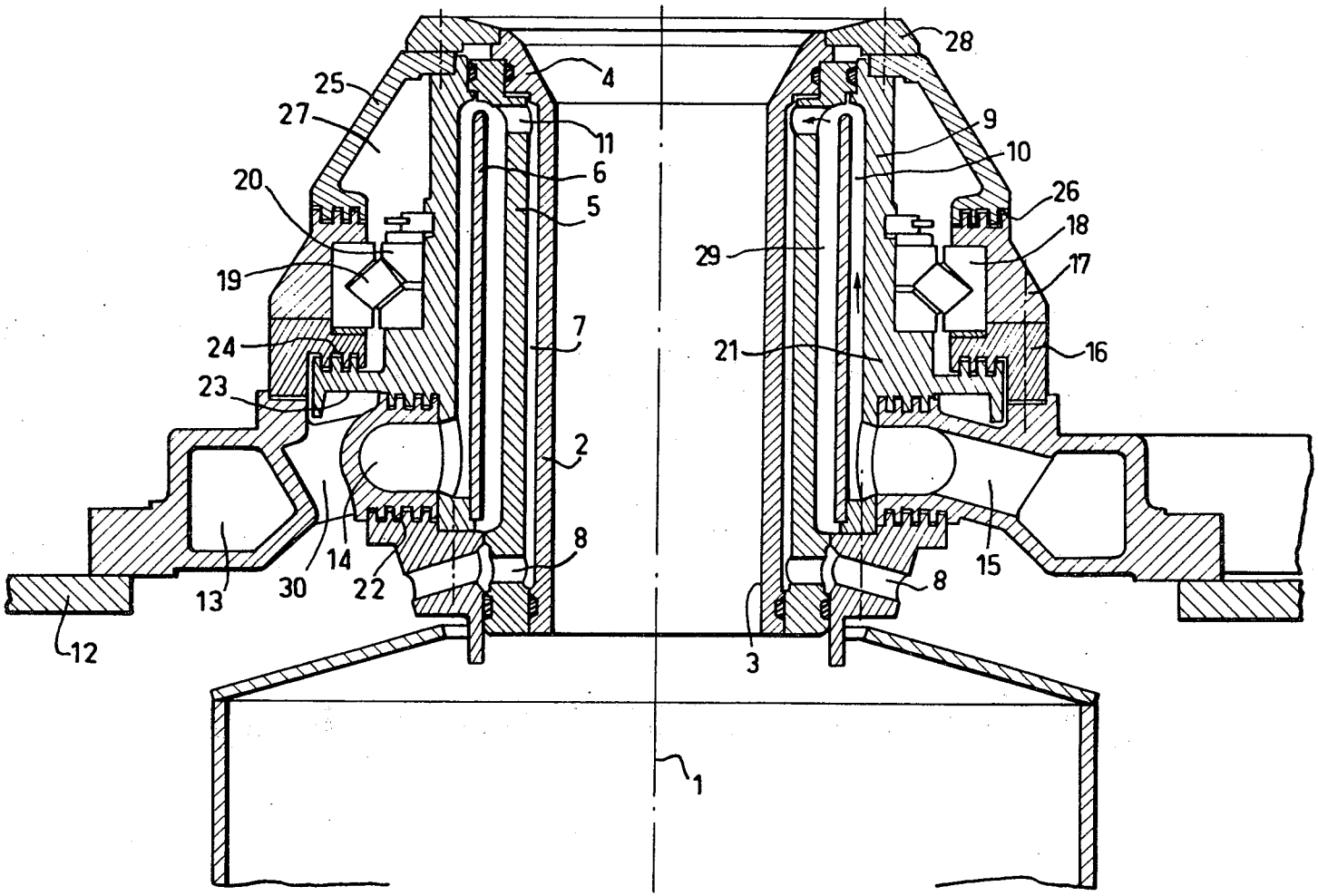
28
9
10
26
18
17
16
15
8
29
21
3
1
4
11
6
5
7
2
8
25
27
20
19
24
23
14
30
22
13
12

INGOT MOLD FOR CONTINUOUS ROTARY CASTING

SUMMARY OF THE INVENTION

This invention relates to an ingot mold for continuous rotary casting of ingots and especially for the preferably oscillatory vertical rotary casting of steel ingots.

Applicant has already described in French Pat. No. 70.47337 filed Dec. 30, 1970, an ingot mold for continuous rotary substantially vertical casting which is cooled from the outside by the circulation of a cooling fluid, and comprises a rotating part constituting the mold proper, which is mounted on bearings and has a cooling wall, and a coaxial stationary part supplied with fluid which contacts the cooling wall, said rotary and stationary parts forming therebetween an annular labyrinth comprising a plurality of teeth which force the cooling fluid to flow along the cooling wall.

Such an ingot mold may be driven in rotation at relatively high speeds without creating substantial friction by reason of the labyrinthine seal which permits it, contrary to other known ingot molds, to be driven directly by the rotation of the ingot as it solidifies, thus eliminating any need for independent means to drive the ingot mold in rotation.

The present invention proposes to improve ingot molds of this type in order to still further facilitate driving of the ingot mold directly from the ingot, even in the case of ingots of small diameter rotating at high speeds. Moreover, the invention proposes to improve the cooling of the liquid metal, such as steel, poured into the ingot mold and improve the formation of the solidified skin thus making it possible to obtain a better quality of ingot and limiting the number of accidental break-outs which cause an overflow of liquid metal.

Finally, the invention also proposes to insure perfect alignment of the ingot mold, thus permitting an improvement in the qualities of the product cast.

It is an object of the invention to provide an ingot mold for use in continuous rotary and substantially vertical casting, which mold is externally cooled by the circulation of a cooling fluid such as water and comprises a rotating part forming the mold proper mounted on a bearing and having a cooling wall the external face of which is cooled by a concentric duct opening outwardly at the lower part of the mold. This rotating part is mounted on a bearing supported by a coaxial stationary part supplied with fluid, the seal between the rotating and stationary parts being provided by two annular labyrinths comprising a plurality of teeth to force said liquid to flow along the cooling wall in the duct. The mold is characterized by the fact that the sationary part comprises a fluid distributing chamber positioned near the lower part of the ingot mold above the outlet of said duct and below said bearing and opening into a second duct formed in the rotating part, concentric with the first duct, between an outer jacket and an inner partition separating the two ducts, said ducts being connected to each other near the upper part of the mold. The jacket has two sets of labyrinthine teeth cooperating with two corresponding sets on the outside of the distribution chamber.

Advantageously the cooling water is introduced into the distributing chamber in a direction favoring the rotation of the rotating part and in an improved embodiment it is possible to provide means such as inclined surfaces or vanes fixed to the rotating part to cause rotation of the rotating part in response to the current of cooling fluid.

In an especially preferred embodiment the rotating part has no member extending radially outside the jacket except for two small collars supporting the labyrinthine teeth cooperating with the corresponding teeth of the stationary part on opposite sides of the bearing. In this way a particularly compact ingot mold is provided having a very low inertia which is consequently capable of being rotated from the start by ingots having only a thin solid skin within the ingot mold.

It will be appreciated that this low inertia may be obtained by reason of the arrangement according to the invention which eliminates any need to protect the race of the bearing in a particular manner against the infiltration of water, because the upper sealing labyrinth for the cooling fluid is positioned clearly below the bearing.

Other advantages and characteristics of the invention will appear from a reading of the following description, given purely by way of illustration and example, with reference to the accompanying drawings, in which the single FIGURE represents an axial sectional view through an ingot mold according to the invention.

The ingot mold according to the invention comprises a part which rotates about a vertical axis 1 and has a cooling wall 2 which is generally cylindrical in shape, the internal surface 3 of which has a conicity between 0.6 and 1.8%, the largest diameter being at the upper part of the mold where it is connected to a frusto-conical section 4.

The rotating part comprises at least one intermediate closed partition. In the embodiment shown, there are two partitions 5, 6 and it will be seen that between the wall 2 and the partition 5 there is an annular cylindrical duct 7 the lower part of which toward the bottom of the ingot mold has outlets in the form of substantially radial orifices 8. The rotating part also comprises an outer jacket 9 forming between itself and the partition 6 an external duct 10 concentric with the duct 7, and it will be seen that the duct 10 is connected to the duct 7 by passages 11 near the upper section 4.

The stationary part of the ingot mold comprises, on a frame 12, an annular duct 13 supplied with cooling water by a suitable inlet not shown.

An annular distributing chamber 14 is positioned concentrically with respect to the duct 13 and supplied partly from the duct 13 through a certain number of passages 15 which may be radial or inclined with respect to a radius so as to create inside the space 14 a circular movement of water compatible with the rotation of the rotating part. It will be seen, moreover, that the annular duct 13 is fixed to a bearing comprising two members 16, 17 supporting a race 18 for the rollers 19. A complementary race 20 is supported by the external surface of the jacket 9 slightly above the horizontal median plane of the ingot mold.

It will be seen that the seal for the cooling fluid between the chamber 14 and the jacket 9 is provided by two horizontal annular labyrinths 21 and 22 having a plurality of teeth carried by the walls of the chamber 14 and the jacket 9 respectively and penetrating into each other with a play of the order of 1 millimeter. It will also be noted that the labyrinth 21 is positioned clearly beneath the level of the bearing having the rollers 19.

The jacket 9 has, beneath the rollers 19 but above the labyrinth 21, a radial, outwardly extending collar 23, having on its upper surface three labyrinth teeth cooperating with three teeth on the members 16 to form an oil sealing labyrinth 24. The radial width of this collar 23 is relatively small so that it has only a small inertia.

A frusto-conical support extends downwardly from the upper part of the jacket 9 while becoming progressively further separated from the jacket, and terminates at its lower end in three labyrinthine teeth cooperating with complementary teeth on the member 17 to form an oil sealing labyrinth 26. It will also be seen that the labyrinth 26 is situated at a relatively small radial distance from the axis 1.

The frusto-conical support 25 and the jacket 9 define therebetween a space 27 supplied with lubricating oil through small ducts (not shown) so that there is created in the space 27 a mist of oil which contributes to the lubrication of the rollers 19.

Finally an annular protective member 28 having a small radial bulk may be attached to the frusto-conical section 14 at the upper part of the mold.

Before beginning to cast a steel ingot utilizing the ingot mold according to the invention a circuit of cooling water is established by feeding water to the annular duct 13 which in turn supplies the chamber 14 which communicates through suitable orifices in the jacket 9 with a peripheral duct 10 and the water rises in this duct in the direction of the arrows. At the upper part of the duct 10 the water passes through the passages 11 and descends inside the duct 7 before being removed through the orifices 8. This results in a direction of the circulation of the cooling water which is the same as the direction of cooling of the ingot. The blind duct 29 between the walls 5 and 6 is filled with water so as to increase the thermal inertia of the assembly without substantially increasing its mechanical inertia.

A small percentage of water which flows out through the labyrinth 21 falls into the passage 30 between the chamber 14 and the annular duct 13 without any risk of becoming mixed with the bearing oil.

This small percentage of water which escapes through the labyrinth thus falls directly without interfering with lubrication.

It will be seen that in this manner the bearing is perfectly projected, which permits the elimination of risks of seizing or jamming.

In order to start the ingot mold according to the invention, once the flow of water has been established, it suffices to pour the liquid steel into its upper part, said steel becoming solidified on a false bar which has first been introduced in a manner known in itself at the lower part of the ingot mold and a solid skin of steel forms against the surface 3. The rotation of the starter plug which is then extracted rotates the ingot skin thus formed and consequently causes the perfectly synchronized rotation of the rotating part of the ingot mold.

It will be appreciated that it is thus possible to eliminate any separate means for rotating the ingot mold as well as the necessary electrical apparatus. Of course, in order to facilitate the rotation, one may also make use of the current of cooling water in such a way as to cause rotation of the rotating part, for example by suitably orienting the orifices in the jacket 9 at the level of the chamber 14, or even by providing on the jacket 9, at all suitable positions, vanes provoking its rotation.

Of course the frame 12 may itself be mounted so as to oscillate vertically along the axis 1 for a process of continuous rotary oscillating casting.

It will also be appreciated that, because the ingot mold has only one bearing, situated substantially at the midpoint thereof and preferably above the midpoint of the ingot mold, vibration of the ingot mold is possible, within the limits of lateral play of the labyrinth teeth thus promoting self alignment of the ingot mold with respect to the ingot and reducing the risks of malalignment between the ingot and the ingot mold.

Of course the ingot mold according to the invention may be modified in many ways. Thus it is possible, in order to still further decrease its inertia, to eliminate the partition 6 and to correspondingly decrease the diameter of the jacket 9 by creating a duct 10 directly between the jacket and the intermediate partition 5.

I claim:

1. In an ingot mold for substantially vertical continuous rotary casting, which mold is externally cooled by the circulation of a cooling fluid and comprises a rotary member mounted on bearings and having a cooling wall the external surface of which is cooled by a concentric duct having an outlet in the lower part of the mold, said rotary member being mounted on a bearing supported by a coaxial stationary part for supplying cooling fluid thereto, a seal between the rotary part and the stationary part being provided by means of annular labyrinths comprising a plurality of teeth to force said fluid to flow along the length of said cooling wall in the duct, the improvement according to which the stationary member comprises a fluid distributing chamber positioned in the lower part of the ingot mold above the outlet of said first-mentioned duct beneath said bearing, and opening into a second duct formed in the rotatary member, concentrically with the first duct, between an external jacket and an internal partition separating the two ducts, said ducts being connected to each other near the upper part of the mold, and said jacket having two sets of labyrinth teeth cooperating with two corresponding sets inside the distribution chamber.

2. Ingot mold as claimed in claim 1 comprising means for introducing cooling water into the distribution chamber in a direction favoring the rotation of the rotatary member.

3. Ingot mold as claimed in claim 2 which comprises means fixed to the rotatary member to cause rotation of the rotating part in response to the effect of the cooling fluid introduced.

4. Ingot mold as claimed in claim 3 in which said means are inclined surfaces or vanes.

5. Ingot mold as claimed in claim 1 in which the rotatary member has no part extending radially outside the jacket except for two small collars supporting the labyrinth teeth cooperating with the corresponding teeth of the stationary part on opposite sides of the bearing.

6. Ingot mold as claimed in claim 1 in which the cooling wall against which the metal is brought for cooling purposes has a conicity between 0.6 and 1.8%.

* * * * *